US005755564A

United States Patent [19]

Machida et al.

[11] Patent Number: 5,755,564

[45] Date of Patent: May 26, 1998

[54] SCROLL FLUID MACHINE HAVING RESILIENT MEMBER ON THE DRIVE MEANS

[75] Inventors: Shigeru Machida, Ibaraki-ken; Akira Suzuki, Shimizu; Kazuaki Shiinoki, Shimizu; Isamu Kawano, Shimizu, all of Japan

[73] Assignee: Hitachi, Ltd., Tokyo, Japan

[21] Appl. No.: 616,272

[22] Filed: Mar. 15, 1996

[30] Foreign Application Priority Data

Mar. 20, 1995 [JP] Japan ..... 7-060370

[51] Int. Cl.[6] ..... F01C 1/04; F01C 17/06

[52] U.S. Cl. ..... 418/55.2; 418/55.3; 418/57; 418/60; 418/83; 418/101

[58] Field of Search ..... 418/55.2, 55.3, 418/57, 60, 83, 101

[56] References Cited

U.S. PATENT DOCUMENTS

| | | | |
|---|---|---|---|
| 4,300,875 | 11/1981 | Fischer et al. | 418/55.3 |
| 4,832,586 | 5/1989 | Emmenthal et al. | 418/55.3 |
| 5,346,374 | 9/1994 | Guttinger | 418/101 |
| 5,417,554 | 5/1995 | Kietzman et al. | 418/101 |
| 5,466,134 | 11/1995 | Shaffer et al. | 418/83 |
| 5,556,269 | 9/1996 | Suzuki et al. | 418/55.3 |

FOREIGN PATENT DOCUMENTS

| | | | |
|---|---|---|---|
| 3230979 | 2/1984 | Germany | 418/55.3 |
| 3538522 | 12/1986 | Germany | 418/55.3 |
| 4116851 | 12/1991 | Germany | 418/55.3 |
| 4203347 | 8/1992 | Germany | 418/55.3 |
| 4214618 | 11/1992 | Germany | 418/55.3 |
| 5-52189 | 3/1993 | Japan . | |

*Primary Examiner*—John J. Vrablik

*Attorney, Agent, or Firm*—Antonelli, Terry, Stout, & Kraus, LLP

[57] ABSTRACT

A scroll compressor includes a drive shaft and an auxiliary drive shaft which are rotatably supported by stationary scrolls, and an orbiting scroll rotatably supported on these drive shafts through cranks. A resilient member is provided on the crank so as to allow thermal expansion of the orbiting scroll in a direction, along which the drive shafts are lined. With this construction, a distance between bearings for the orbiting scroll and the stationary scrolls is adjusted in accordance with the thermal expansion, and therefore even when the thermal expansion occurs, a smooth motion of the scroll will not be affected.

12 Claims, 14 Drawing Sheets

SCROLL FLUID MACHINE HAVING RESILIENT MEMBER ON THE DRIVE MEANS

BACKGROUND OF THE INVENTION

This invention relates generally to a displacement compressor of the orbital type which compresses gas while decreasing the volume of a compression operating chamber, and more particularly to a scroll compressor of the type in which a crescent-like compression chamber is formed by scroll members of a volute configuration.

In a scroll compressor, two scroll members, each having a volute wrap formed perpendicularly on a mirror plate, are engaged with each other, and the two scroll members perform orbital movements relative to each other, with one of the two scroll members fixed against rotation relative to the other, thereby compressing gas from the outer peripheral portions of the scroll members toward the central portions of the scroll members. There is known one scroll compressor of this type in which the pressure of gas within a compression chamber, which is defined by scroll wraps, urges an orbiting scroll and a stationary scroll away from each other. There is also known another scroll compressor of the type described in which two wraps are formed respectively on opposite sides or surfaces of a mirror plate of an orbiting scroll, and two compression operating chambers are formed respectively on the opposite sides of the mirror plate so that thrust forces due to compressed gas can be canceled. Japanese Patent Unexamined Publication No. 5-52189 discloses the latter technique. In this conventional construction, the orbiting scroll, having teeth formed respectively on opposite sides thereof, is interposed between two stationary scrolls, and two drive shafts are provided at the outer peripheral portion of the orbiting scroll, and are rotatably supported by bearings mounted on the two stationary scrolls. A gear is mounted on one end of each of the two drive shafts, and is in mesh with a gear mounted on a shaft of an electric motor. When this motor shaft rotates, the two drive shafts (i.e., crankshafts) are rotated. The orbiting scroll is engaged with eccentric portions of the drive shafts, and is driven by the rotating crankshafts to make an orbital motion with a predetermined radius.

In the above conventional construction, the orbiting scroll is interposed between the two parallel, opposed stationary scrolls, and the two orbiting scroll-driving crankshafts are rotatably supported by the stationary scrolls through roller bearings. Generally, a distance between the axes (centerlines) of the two bearings mounted on the stationary scroll is equal to a distance between the axes of bearings mounted on the orbiting scroll in order to achieve a stable motion of the orbiting scroll and also to maintain high reliability of the bearings. In the above conventional construction, since the two stationary scrolls are disposed parallel to each other, a distance between the axes of the two bearings mounted on one of the two stationary scrolls is equal to a distance between the axes of the two bearings of the other stationary scroll.

On the other hand, when the above conventional scroll fluid machine is operated as a compressor, not only the machine body but also central portions of the scrolls are heated to high temperatures by compression heat. In the scroll fluid machine, compression and expansion are effected with the stationary scroll and the orbiting scroll held in slight contact with each other (more specifically, each scroll is in contact with the mirror plate of the mating scroll, or the scrolls are in contact with each other though the non-contact operation is basically desirable, which is difficult because of the principles), and therefore the temperature of the scrolls becomes high because of this frictional heat. As a result, a orbiting scroll, interposed between the stationary scrolls, is thermally expanded radially. The stationary scrolls are also thermally expanded, but since the stationary scrolls have outwardly-exposed surfaces, the amount of thermal expansion thereof is relatively smaller than that of the orbiting scroll the whole of which is liable to be heated. As a result, a distance between the axes of the two bearings, mounted on the stationary scroll, and a distance between the axes of the two bearings, mounted on the orbiting scroll, become different from each other, and hence become unequal to each other. As a result, in addition to the centrifugal force of the orbiting scroll and the gas compression force, the load, corresponding to the relative thermal expansion amount difference, acts on the two drive shafts. This load acts to increase the distance between the two drive shafts (that is, urges the two drive shafts away from each other radially outwardly), so that the drive shafts can not smoothly rotate. If the drive shafts thus fail to smoothly rotate, the quiet operation of the compressor is adversely affected, and further if the relative thermal expansion amount difference between the distance between the axes of the two bearings, mounted on the orbiting scroll, and the distance between the axes of the two bearings, mounted on the stationary scroll, becomes extremely large, the compressor no longer performs the proper or normal operation.

If the scroll fluid machine is sufficiently cooled so as to avoid the influence of the above thermal expansion, there has been encountered a problem that the compressed gas-producing apparatus, using this scroll fluid machine, becomes large in size.

SUMMARY OF THE INVENTION

It is an object of this invention to provide a scroll fluid machine which can perform a proper operation even if thermal expansion occurs.

Another object of this invention is to provide a compressed gas-producing apparatus which is compact in size, and is lightweight.

To the above end, the present invention has a fundamental feature in that there is provided a constitution which compensates for a relative difference in thermal expansion between a stationary scroll and an orbiting scroll.

According to one aspect of the present invention, there is provided a scroll fluid machine including:

- a stationary scroll or scrolls having a scroll wrap of a volute configuration,
- an orbiting scroll having a scroll wrap engaged with the scroll wrap of the stationary scroll or scrolls, and
- a plurality of drive means which are of drive means being rotated in synchronism with each other and which are rotatable at respective portions thereof where said drive means are fitted in the stationary scroll, and impart an eccentric motion to the orbiting scroll at respective portions thereof where said drive means are fitted in the orbiting scroll, and
- a resilient member or members provided at one of the fitted portions of one of the drive means.

According to another aspect of the invention, there is provided a scroll fluid machine including

- a stationary scroll or scrolls having a scroll wrap of a volute configuration,
- a plurality of drive shafts mounted on the stationary scroll or scrolls for rotation in synchronism with each other, and having crank means, an orbiting scroll adapted to be revolved by the crank means of the drive shafts, and having a scroll wrap engaged with the scroll wrap of the stationary scroll or scrolls, and means for allowing expansion of the orbiting scroll in a direction of juxtaposition of the drive shafts.

According to a further aspect of the invention, there is provided a compressed gas-producing apparatus using as a compressor a scroll fluid machine which comprises:

a stationary scroll or scrolls having a scroll wrap of a volute configuration, a plurality of drive shafts mounted on the stationary scroll or scrolls for rotation in synchronism with each other, and having means, and an orbiting scroll revolved by the crank means of the drive shafts, and having a scroll wrap engaged with the scroll wrap of the stationary scroll or scrolls, wherein inner surfaces of the stationary scroll and the orbiting scroll or scrolls are surface-treated to have self-lubricating properties.

When a scroll fluid machine is operated as a compressor, the degree of thermal expansion of an orbiting scroll is higher than that of a stationary scroll as described above. In the scroll fluid machine, the orbiting scroll is revolved by crank means provided respectively on a plurality of drive shafts on the stationary scroll which rotate in synchronism with each other. When the thermal expansion difference develops between the orbiting scroll and the stationary scroll, no problem arises in a direction perpendicular to the direction of juxtaposition of the drive shafts because the machine is so designed as to allow such thermal expansion. However, the drive shafts rotatably mounted on the stationary scroll limit or prevent the thermal expansion in the direction of juxtaposition of the drive shafts, so that the expansion of the orbiting scroll causes deflection or flexure of the drive shafts.

In the present invention, there is provided means for allowing the expansion of the orbiting scroll in the direction of juxtaposition of the drive shafts, and therefore even if the expansion balance between the orbiting scroll and the stationary scroll is lost, so that the orbiting scroll is expanded to a higher degree, the burden or load on the drive shafts is relieved, so that the rotation of the drive shafts will not be prevented, since the orbiting scroll is allowed to expand in the direction of juxtaposition of the drive shafts.

The scroll fluid machines have heretofore been cooled by lubricating oil. In the present invention, however, the inner surfaces of the stationary scroll and the orbiting scroll are surface-treated to have self-lubricating properties. Therefore, an oil tank, an oil cooler, an oil-circulating pump, a device for controlling the pump and so on, which have heretofore been used in the conventional construction, are unnecessary, and therefore there can be provided the compressed gas-producing apparatus which is compact and lightweight.

DESCRIPTION OF THE PREFERRED EMBODIMENTS

Figure 1:
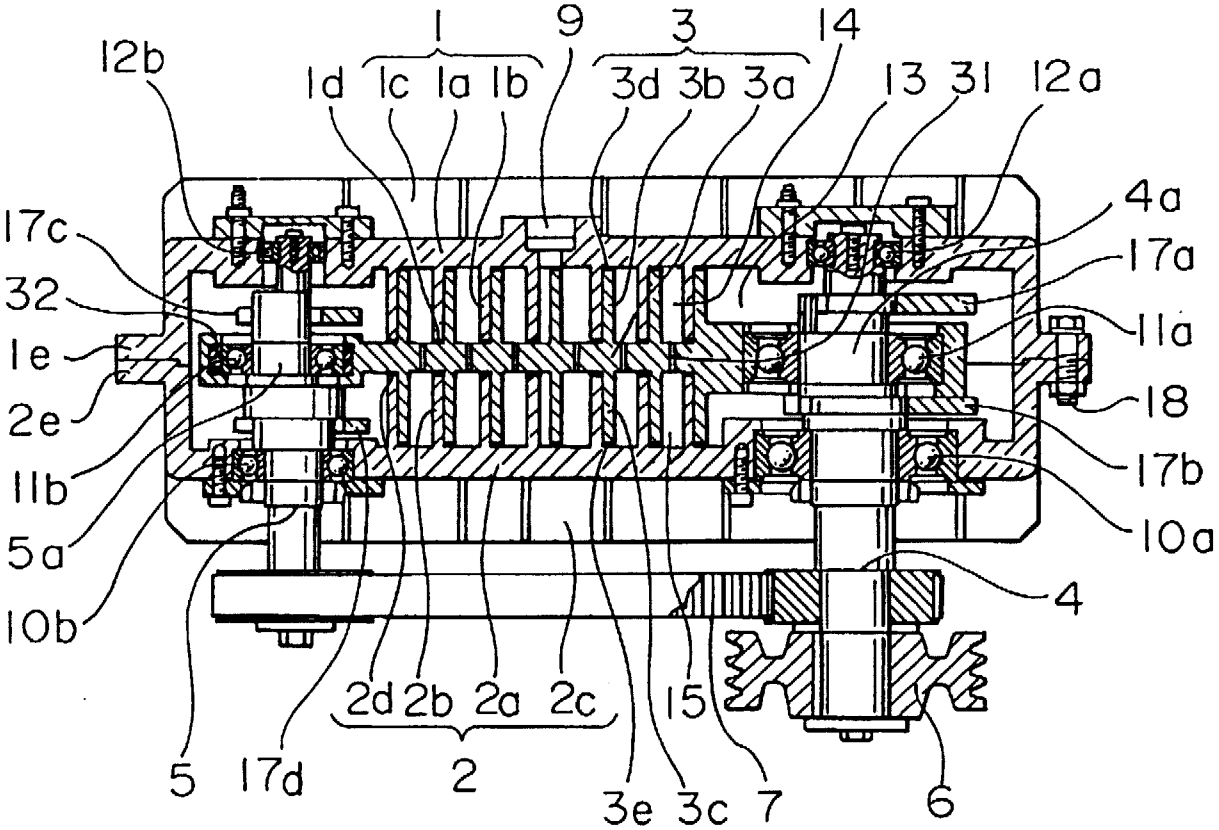
FIG. 1 is a cross-sectional view of one preferred embodiment of a double scroll compressor of the present invention.

A preferred embodiment of an oil free-type air compressor of the invention, employing a double scroll-type fluid machine, will now be described with reference to FIG. 1. A pair of stationary scrolls 1 and 2 are arranged parallel to each other, and an orbiting scroll 3 is interposed between the two stationary scrolls 1 and 2, and is engaged therewith, so that two compression operating chambers 14 and 15 are formed respectively on opposite sides of a mirror plate 3*a* of the orbiting scroll 3. Each of the stationary scrolls 1 and 2 is made of an aluminum alloy in order to enhance its self-lubricating properties, and the orbiting scroll 3 is also made of an aluminum alloy. The stationary scroll 1 has a wrap 1*b* of a volute configuration formed perpendicularly on a mirror plate 1*a*, and similarly the stationary scroll 2 has a wrap 2*b* of a volute configuration formed perpendicularly on a mirror plate 2*a*. The orbiting scroll 3 has a pair of wraps 3*b* and 3*c* of a volute configuration formed perpendicularly on the opposite sides or faces of the mirror plate 3*a*, respectively. In order to enhance the lubricating properties, tip seals 1*d*, 2*d*, 3*d* and 3*e* are formed respectively on tips or distal ends of the wraps 1*b* and 2*b* of the stationary scrolls 1 and 2 and the wraps 3*b* and 3*c* of the orbiting scroll 3, these tip seals 1*d*, 2*d*, 3*d* and 3*e* being made of a composite material comprising an inorganic material such as carbon, a tetrafluoroethylene resin or a polyimide resin or the like. A plurality of communication holes 31, which communicate the upper and lower compression operating chambers 14 and 15 with each other, are formed through the mirror plate 3a of the orbiting scroll 3. A flow passage 8 (see FIG. 3) is formed through a central portion of the mirror plate 3a. A drive shaft 4, having an eccentric crank portion 4a, and an auxiliary crankshaft (drive shaft) 5, having an eccentric crank portion 5a, are provided at an outer peripheral portion of the mirror plate 3a of the orbiting scroll 3 in such a manner that the orbiting scroll 3 is generally interposed between the drive shaft 4 and the auxiliary crankshaft 5. The amount of eccentricity of the crank portion 4a is equal to that of the crank portion 5a. The orbiting scroll 3 is rotatably engaged with the crank portion 5a of the auxiliary crankshaft 5 through a roller bearing 11b having a resilient (elastic) support portion 32, and is also rotatably engaged with the crank portion 4a of the drive shaft 4 through a roller bearing 11a. The stationary scroll 1 has a discharge port 9 provided at a generally central portion thereof, and heat-radiating fins 1c are formed in a discontinuous manner on the stationary scroll 1 over an entire outer surface thereof. The stationary scroll 1 has a flange 1e formed at its outer periphery. The other stationary scroll 2 has similar heat-radiating fins 2c formed on an outer surface thereof to those on the stationary scroll 1, and also has a flange 2e formed at its outer periphery. The two stationary scrolls 1 and 2 are connected or fastened together at the flanges 1e and 2e by bolts 18 or the like. For assembling this structure, the two stationary scrolls 1 and 2 and the orbiting scroll 3 are properly positioned with respect to one another by positioning means 16 (for example, knock pins 28b shown in FIG. 9) which serve to position the two stationary scrolls 1 and 2 with respect to each other.

The drive shaft 4 is rotatably supported by a roller bearing 10a (which is fixedly secured at a portion thereof to the stationary scroll 2) against axial movement, and a distal end of the drive shaft 4 is rotatably engaged with a bearing 12a fixedly mounted the other stationary scroll 1. Balance weights 17a and 17b are fixedly mounted on the drive shaft 4, and balance weights 17c and 17d are fixedly mounted on the auxiliary crankshaft 5, and these balance weights 17a to 17d are disposed in a suction atmosphere. Similarly, the auxiliary crankshaft 5, disposed in opposite relation to the drive shaft 4, is rotatably supported by a roller bearing 10b (which is fixedly secured to the stationary scroll 2) against axial movement, and a distal end of this crankshaft 5 is rotatably engaged with a bearing 12b fixedly mounted on the stationary scroll 1. A pulley 6 is mounted on the drive shaft 4, and a rotational power force is supplied from a power source (not shown) to the pulley 6 through a power transmission means (not shown). The drive shaft 4 and the auxiliary crankshaft 5 are connected together by a timing belt 7 so that the two shafts 4 and 5 can be rotated in synchronism with each other.

Figure 9:
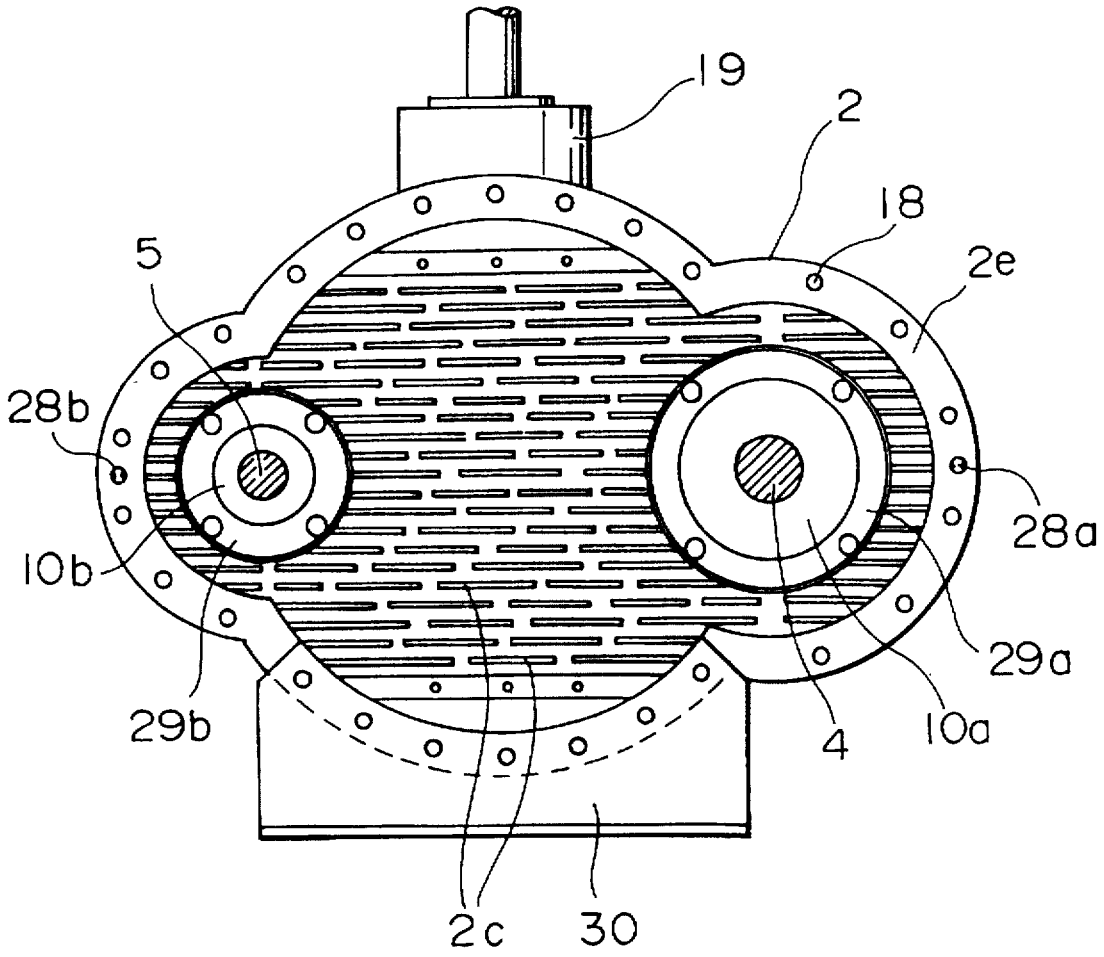
FIG. 9 is a side-elevational view showing a modified stationary scroll of the invention (for example, taken along the line M—M of FIG. 7)

A suction (intake) port 19 for gas is provided, for example, across the two stationary scrolls, and extends in a direction perpendicular to the drive shaft 4 as shown in FIG. 9. A leg 30 for installing the compressor is provided at the lower side facing away from the suction port 19. As described above, the stationary scrolls 1 and 2 and the orbiting scroll 3 can be made of a lightweight material with good thermal conductivity, such as an aluminum alloy. For providing the oil free-type compressor, an aluminum alloy containing silicone can be used to form these scrolls. Furthermore, for enhancing the lubricating ability of the scroll wraps when they are in contact with each other, the scroll wraps can be surface-treated to be coated with an anodic oxide film. The material for the orbiting scroll should be lower in thermal expansion coefficient than the material for the stationary scrolls.

Figure 2:
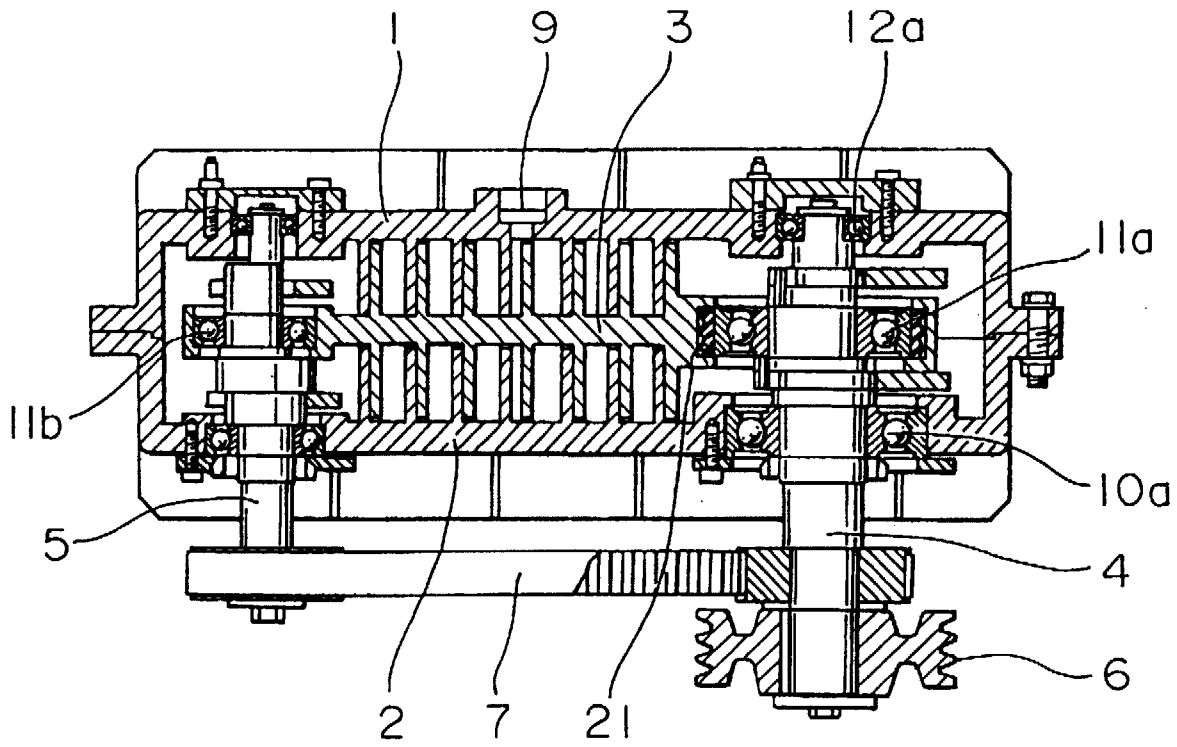
FIG. 2 is a cross-sectional view of another embodiment of a double scroll compressor of the invention.

FIG. 2 shows another embodiment of the invention. This embodiment differs from the embodiment of FIG. 1 in that an resilient (elastic) member 21 is provided between the bearing 11a, engaged with the drive shaft 4, and the orbiting scroll 3.

In the scroll compressor, since the orbiting scroll revolves at high speed relative to the stationary scrolls, the temperature of the relevant portions becomes high by frictional heat, and therefore lubricating oil is usually used for cooling these portions. In this case, the oil is contained in the compressed gas discharged from the discharge port 9, and the oil has impurities in some applications, and hence is not desirable. Therefore, the wraps of the scrolls and the tip seals are made of a self-lubricating material as described above, thus achieving the oil-free construction.

Even though the friction is reduced, the frictional heat is still generated, and besides the temperature of the compressed air discharged from the discharge port 9 is high (200° C. to 230° C.), and therefore if the cooling is not effected sufficiently, the compressor is subjected to thermal expansion. If the degree of thermal expansion of the stationary scrolls is generally the same as that of the orbiting scroll, there is no problem. However, the stationary scrolls are in contact with the outside or ambient air whereas the orbiting scroll is not in contact with the outside air, and therefore the temperature of the orbiting scroll becomes higher. Expressing this in terms of measured values, the temperature of the stationary scrolls rises to 160° C. whereas the temperature of the orbiting scroll rises to 160° C. to 230° C. As a result, in the case where a distance between the axis of the drive shaft 4 and the axis of the auxiliary crankshaft 5 is 280 mm, it has been observed that the amount of expansion of the orbiting scroll is 0.1 mm to 0.15 mm larger than that of the stationary scrolls.

Figure 8:
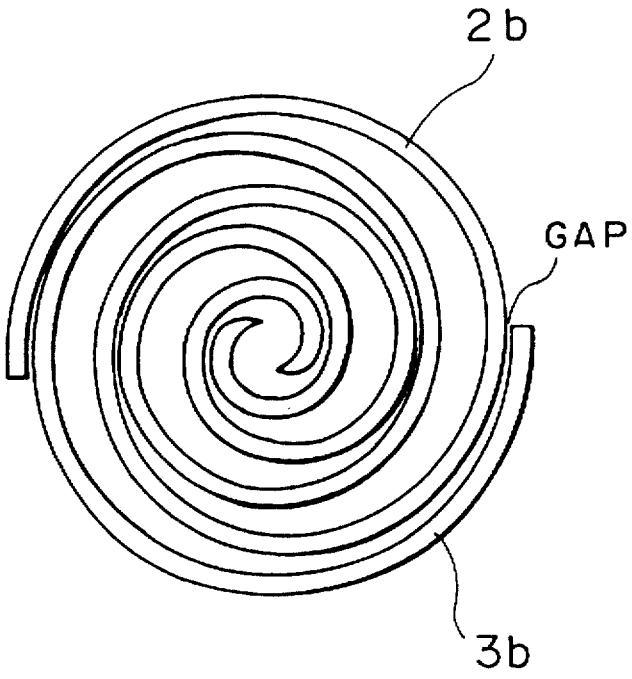
FIG. 8 is a view explanatory of thermal expansion of scrolls.

The orbiting scroll is thermally expanded in all directions. As a result of this thermal expansion, the side surfaces of the mating wraps are brought into firm contact with each other, so that the orbiting scroll fails to revolve smoothly. In this embodiment, to overcome this problem, the radius of revolution (orbital motion) of the orbiting scroll is made smaller than a theoretical value determined by the configuration of the teeth of the stationary scrolls. The radius of revolution of the orbiting scroll is made smaller than the theoretical value by providing offset in the amount of eccentricity of the crank portions of the two drive shafts. Therefore, in the assembled condition of the compressor (that is, when the compressor is in a cooled condition), a gap is formed between the side surfaces of the mating wraps as shown in FIG. 8. Therefore, even when the orbiting scroll is thermally expanded in all directions, the compressor can be operated without causing a firm contact between the side surfaces of the mating wraps.

If there is no factor which prevents the thermal expansion of the orbiting scroll, no problem is encountered in providing offset in the eccentricity amount. However, as shown in FIG. 1, the drive shaft 4 and the auxiliary crankshaft 5 are rotatably supported or borne by the stationary scroll 1, and the orbiting scroll 3 is supported on these drive shafts through the crank portions. Therefore, the thermal expansion of the orbiting scroll 3 due to heat in a direction of juxtaposition of the two drive shafts 4 and 5 is prevented by the two drive shafts. On the other hand, the expansion is not prevented by the above offset of the eccentricity amount in all directions except the direction of juxtaposition of the two drive shafts.

In the above embodiments, the resilient support portion 32 or the resilient member 21 is provided as means for allowing the expansion in the direction of juxtaposition of the two drive shafts, and therefore even when the orbiting scroll is expanded, the expansion is not prevented or limited, so that the operation of the scroll will not be adversely affected.

The operation of the compressors of FIGS. 1 and 2 will now be described. When a rotational power force is transmitted to the pulley 6, the drive shaft 4 rotates, and further the auxiliary crankshaft 5 rotates in synchronism with the drive shaft 4 through the timing belt 7. Therefore, an orbital motion, having a radius corresponding to the amount of eccentricity of the drive shaft 4 and the auxiliary crankshaft 5, is simultaneously imparted to the orbiting scroll 3. As a result, the gas is drawn through the suction port 19 into a suction chamber 13. Then, the gas flows into the compression operating chambers 14 and 15, provided respectively on the upper and lower sides of the mirror plate 3*a* of the orbiting scroll 3, and then the gas in the chambers 14 and 15 is compressed to a predetermined pressure. The gas, compressed in the compression operating chamber 15, flows through the communication hole 8 (formed through the central portion of the mirror plate 3*a*) into a discharge space at the central portion of the upper compression operating chamber 14, and joins the gas compressed in the compression operating chamber 14 on the upper side of the orbiting scroll mirror plate 3*a*, and then the thus combined gas is discharged through the discharge port 9 on the stationary scroll 1 to the exterior of the compressor. During the compressing operation, the compression heat can not be cooled within the compressor since no lubricating oil is present in the compression operating chambers 14 and 15. However, this heat is effectively removed by forced air-cooling, that is, by forcibly flowing the air through duct structures respectively covering the heat-radiating fins 1*c* and 2*c* formed respectively on the outer surfaces of the stationary scrolls 1 and 2. Therefore, the orbiting scroll, as well as the stationary scrolls, is kept to the proper temperature. Because of the provision of the communication holes 31, the total thrust force of the gas in the compression operating chamber 14 on the upper side of the mirror plate 3*a* is substantially equal to the total thrust force of the gas in the compression operating chamber 15 on the lower side of the mirror plate 3*a*, and therefore any large thrust force will not act on the distal end (surface) of each wrap. Therefore, a sliding movement loss at the distal end of the wrap can be kept to a minimum. And besides, since the thrust forces acting on the orbiting scroll 3 are balanced with each other, the positioning means for the bearings 11*a* and 11*b* supporting the orbiting scroll 3 can be simplified, and this enhances the assembling efficiency. In this embodiment, the resilient member 32, provided between the auxiliary crankshaft 5 and the bearing 11*b* mounted on the orbiting scroll 3, accommodates for the thermal expansion difference between the orbiting scroll and the stationary scrolls, so that the distance between the axes of the bearings on the orbiting scroll is kept substantially equal to the distance between the axes of the bearings on the stationary scrolls during the operation. In the embodiment shown in FIG. 2, the resilient member 21, provided between the drive shaft 4 and the bearing 11*a* mounted on the orbiting scroll, accommodates for the thermal expansion difference between the orbiting scroll and the stationary scrolls, so that the distance between the axes of the bearings on the orbiting scroll is kept substantially equal to the distance between the axes of the bearings on the stationary scrolls during the operation.

Incidentally, a compressor which outputs a high discharge pressure of not less than 0.5 Mpa is a large-capacity one capable of producing at least several h.p., and if the capacity of the compressor is large, a scroll configuration is large, and therefore an orbiting scroll is large in size, so that a centrifugal force produced during the operation is large. Therefore, in order to reduce the centrifugal force of the orbiting scroll during the operation, it is necessary to reduce the weight of the orbiting scroll, and for this purpose the orbiting scroll is made of a lightweight material such as an aluminum alloy. Furthermore, in order to make the amount of thermal expansion of the stationary scrolls as equal to that of the orbiting scroll as possible and also to reduce the overall weight of the compressor, the two stationary scrolls are also made of a lightweight material, such as an aluminum alloy, as in the orbiting scroll.

Figure 3:
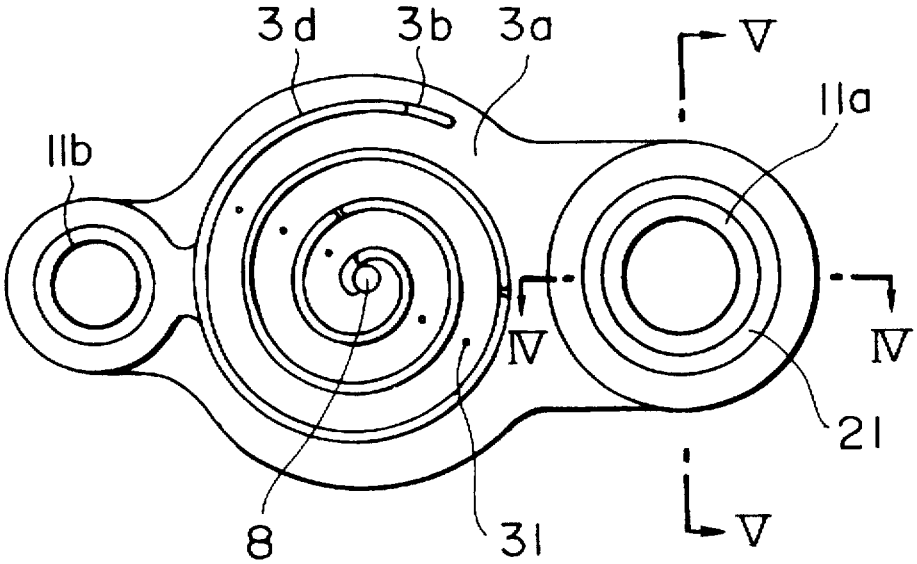
FIG. 3 is a plan view of an orbiting scroll used in the invention.
Figure 4:
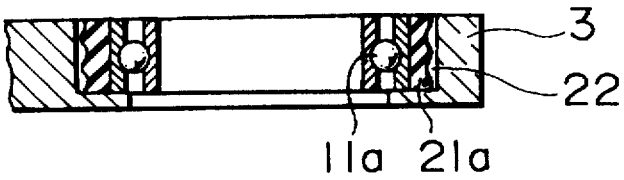
FIG. 4 is cross-sectional view taken along the line IV—IV of FIG. 3, showing a bearing portion of the orbiting scroll.
Figure 5:
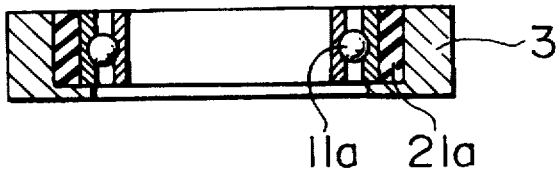
FIG. 5 is a cross-sectional view taken along the line V—V of FIG. 3, showing the bearing portion of the orbiting scroll.

A further embodiment of the invention, directed particularly to means for elastically or resiliently supporting an orbiting scroll 3, will now be described with reference to FIGS. 3 to 6A. FIG. 3 is a plan view of the orbiting scroll as used in the embodiment of FIG. 2. A flow passage 8 is formed at a generally central portion of the scroll, and a plurality of communication holes 31 are formed through a mirror plate 3*a*, and are provided every about 180° along the scroll wrap 3*b*, and each of the communication holes 31 is disposed substantially midway between the corresponding adjacent turns of the wrap 3*b*. A roller bearing 11*a* is mounted on a drive shaft 4, and a resilient (elastic) member 21 is provided between the bearing 11*a* and the orbiting scroll 3. FIGS. 4 and 5 show one example of this resilient member, and FIG. 4 is a cross-sectional view taken along the line IV—IV of FIG. 3, and FIG. 5 is a cross-sectional view taken along the line V—V of FIG. 3. As shown in FIG. 4, the resilient member 21*a* of rubber, mounted on the periphery of the roller bearing 11*a*, has a portion having an outer peripheral surface corrugated, and a slight gap 22 is formed between this corrugated outer peripheral surface and an inner peripheral surface of a bearing-mounting portion of the orbiting scroll 3. As shown in FIG. 5, the resilient member 21*a* provided around the roller bearing 11*a* an outer peripheral surface which is linear incross-section and is held in intimate contact with the inner peripheral surface of the bearing-mounting portion of the orbiting scroll 3. The corrugated portion shown in FIG. 4 circumferentially extends ±30°–60° from the line V—V of FIG. 3. Similarly, the linear portion shown in FIG. 5 circumferentially extends over a predetermined region. With this construction, the distance between the two bearings is liable to be changed in the direction passing through the axes of the two bearings. Therefore, when the orbiting scroll 3 is thermally expanded, the bearing 11*a* is liable to be displaced in the direction IV—IV, but is liable to be restricted in the direction V—V. The purpose of suppressing the displacement of the bearing 11*a* in the direction V—V is to prevent the rotation of the orbiting scroll. The resilient member may comprise a ring-shaped member formed of a polymeric material (rubber-like material). In this case, in view of the load to be applied, a plurality of polymeric members may be mounted on the periphery of the bearing.

Figure 6A:
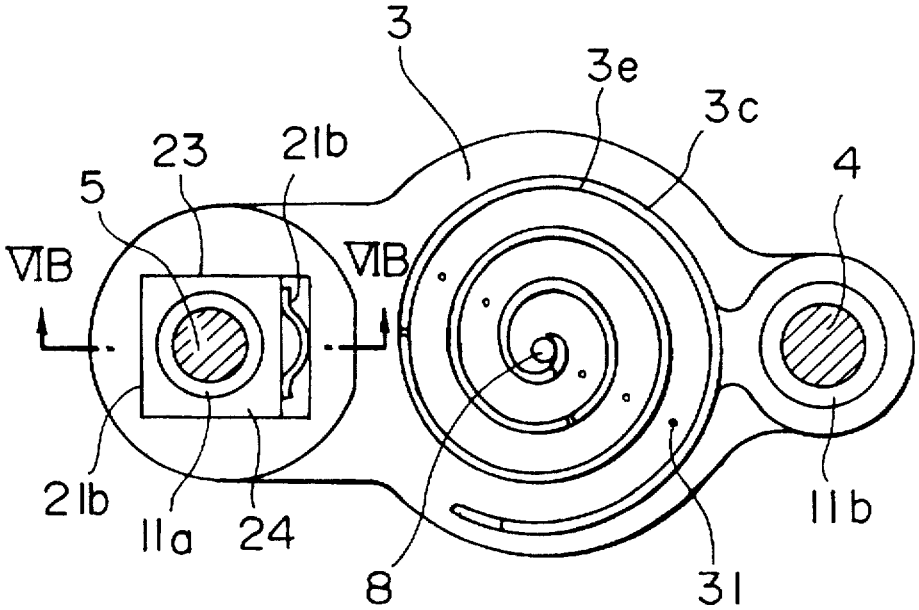
FIG. 6A is a plan view of an orbiting scroll in a further embodiment of the invention.
Figure 6B:
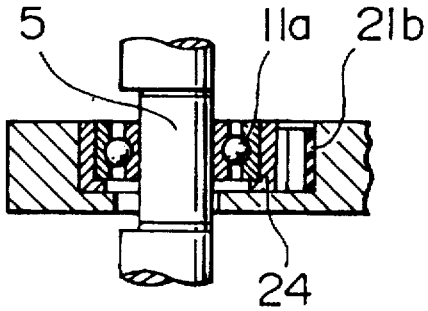
FIG. 6B is a cross-sectional view taken along the line VIB—VIB of FIG. 6A.

A still further embodiment of the invention will now be described in terms of a unique feature in this embodiment with reference to FIGS. 6A and 6B. An auxiliary bearing box 24 is provided on the drive shaft side of the orbiting scroll 3, and is prevented against movement in a circumferential direction, but is allowed to move in a direction passing through two bearings 11*a* and 11*b*. In this embodiment, a square groove 23 is formed in the orbiting scroll 3, and the auxiliary bearing box 24, having the bearing 11*a* fixedly mounted therein, is mounted, together with a metal spring 21*b* (e.g. leaf spring), in the square groove 23. In this embodiment, the metal spring 21*b* can be resiliently deformed to adjust a distance between the two bearings 11*a* and 11*b*. In this embodiment, the direction of displacement of the resilient member 21*b* is more limited, and therefore the bearing 11*a* can be moved only in the direction IVB—IVB (that is, in the direction of juxtaposition of two drive shafts 4 and 5), and is prevented for movement in the direction V—V perpendicular to the direction of juxtaposition of the two drive shafts. Therefore, the orbiting scroll 3 can achieve the more stable movement.

In this embodiment, unlike the above embodiments, the resilient member is made of the metal material, and therefore is not deteriorated over a longer period of time, and since the bearing 11*a* is fixedly mounted in the auxiliary bearing box 24, the posture of the bearing 11*a* is kept unchanged, so that the point of application of the load, as well as the rolling surface of the bearing, is substantially kept constant. Therefore, the bearing is used properly, and this achieves high reliability.

A further embodiment of the invention will now be described with reference to FIG. 7. This embodiment is directed to a scroll compressor in which for allowing an orbiting scroll 3 to expand in a direction of juxtaposition of two drive shafts 4 and 5, bearings 12*b* and 10*b*, which are mounted respectively on stationary scrolls 1 and 2 to support the auxiliary crankshaft (drive shaft) 5, are resiliently (elastically) supported through resilient members 33 and 34, respectively. In this embodiment, the thermal expansion difference between the orbiting scroll 3 and the stationary scrolls 1 and 2 is accommodated for on the stationary scroll side (that is, by the resilient members 33 and 34 mounted respectively on the stationary scrolls 1 and 2). The resilient support members can be formed of rubber, or can comprise a metal spring, as described above. With this construction, the maintenance of the compressor can be effected more easily as compared with the case where the resilient member is provided at the crank portion of the orbiting scroll. Since the resilient members are provided on the stationary scrolls 1 and 2, respectively, each of the resilient members can be removed for replacement with a new one merely by removing screws.

In the above embodiments, although the orbiting scroll 3 is allowed to expand, it is desirable that the stationary scrolls 1 and 2 follow the expansion of the orbiting scroll as much as possible. Cooling fins 1*c* and 2*c* are formed respectively on the stationary scrolls 1 and 2 so as to lower the overall temperature. Without the fins 1*c* and 2*c*, the thermal expansion difference would be increased. In conventional constructions, a plurality of relatively-long cooling fins have been arranged in rows in parallel relation to the direction of juxtaposition of two drive shafts, each of the cooling fins extending generally from one end of a stationary scroll to the other end thereof. With such arrangement, however, the stationary scrolls are prevented from extending in the direction of juxtaposition of the two drive shafts. Further embodiments of the invention for overcoming this problem will now be described with reference to FIGS. 9 to 11. In these embodiments, heat-radiating fins are so arranged as to effectively cool the whole of a compressor and also to allow each stationary scroll to thermally expand easily in a direction passing through two bearings mounted on the stationary scroll. With this arrangement, the thermal expansion difference between an orbiting scroll and the stationary scrolls is reduced. In order that the heat-radiating fins on the stationary scrolls will not limit or suppress the thermal expansion of the stationary scroll, the heat-radiating fins are arranged discontinuously in the direction passing through the two bearings, or arranged in a direction perpendicular to the direction passing through the two bearings, or radially arranged. Therefore, the heat-radiating fins, formed on the outer surfaces of the stationary scrolls, effectively cool the compressor body, and are less liable to prevent the thermal expansion of the stationary scrolls. With this arrangement, the stationary scroll is liable to thermally expand at least in the direction passing through the two bearings, and therefore the thermal expansion difference between the orbiting scroll and the stationary scrolls in this direction is much reduced. These embodiments will be described sequentially below.

Figure 7:
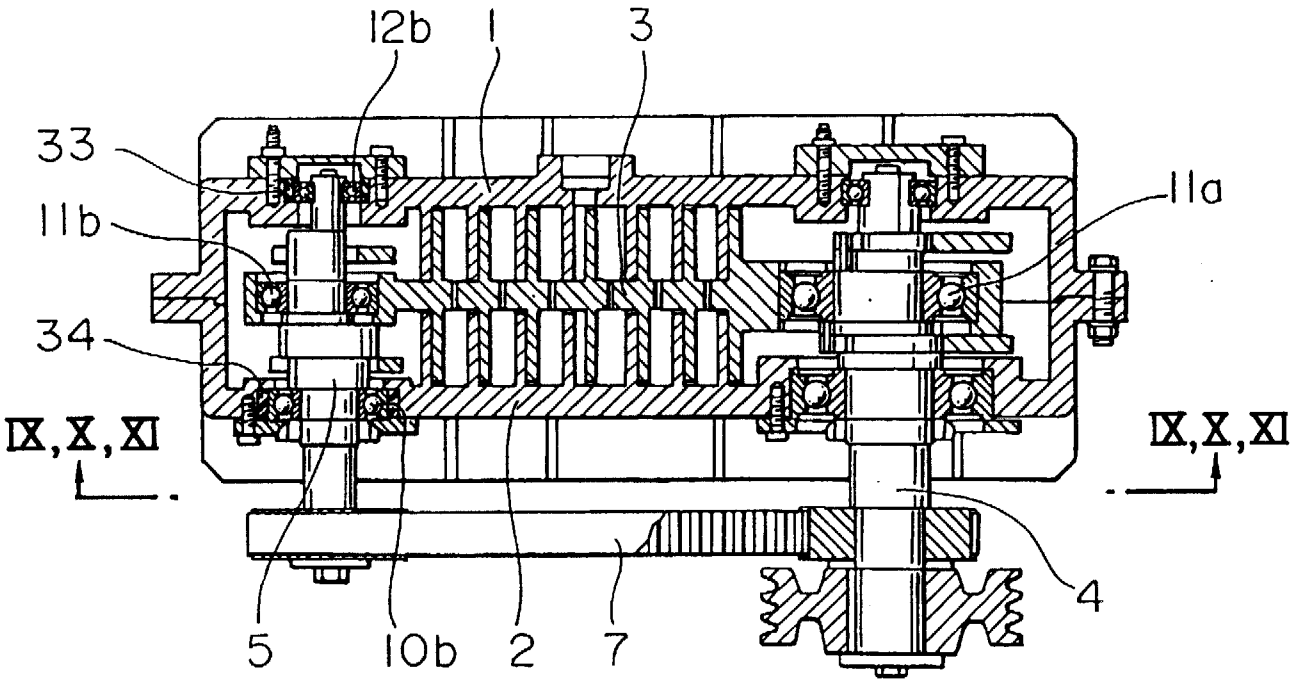
FIG. 7 is a cross-sectional view of a further embodiment of a double scroll compressor of the invention.

FIG. 9 is a view as seen from the line M—M' of FIG. 7. The scroll compressor has the suction port 19 at its upper portion, and includes the support base (leg) 30 at its lower portion. The fins 2*c* are formed on the outer surface of the compressor (that is, on the outer surface of the stationary scroll 2) over the entire area thereof except those portions thereof where bearing covers 29*a* and 29*b* are provided. The stationary scrolls 1 and 2 are fixedly connected to each other by bolts 18 passing through a flange 2*e*, and the relative position of the two stationary scrolls 1 and 2 is determined by a knock pin 28*a*. In this embodiment, the fins 2*c* are arranged or oriented in the direction passing through the two bearings 10*a* and 10*b*, and cooling air is caused to flow along the fins 2*c*, thereby cooling the compressor. Each fin 2*c* is interrupted at intervals or divided into a plurality of sections in the direction passing through the two bearings 10*a* and 10*b*, and therefore in contrast with long continuous fins, the discontinuous fins 2*c* will not limit the thermal expansion of the stationary scroll 2 in the direction passing through the two bearings 10*a* and 10*b*.

Figure 10:
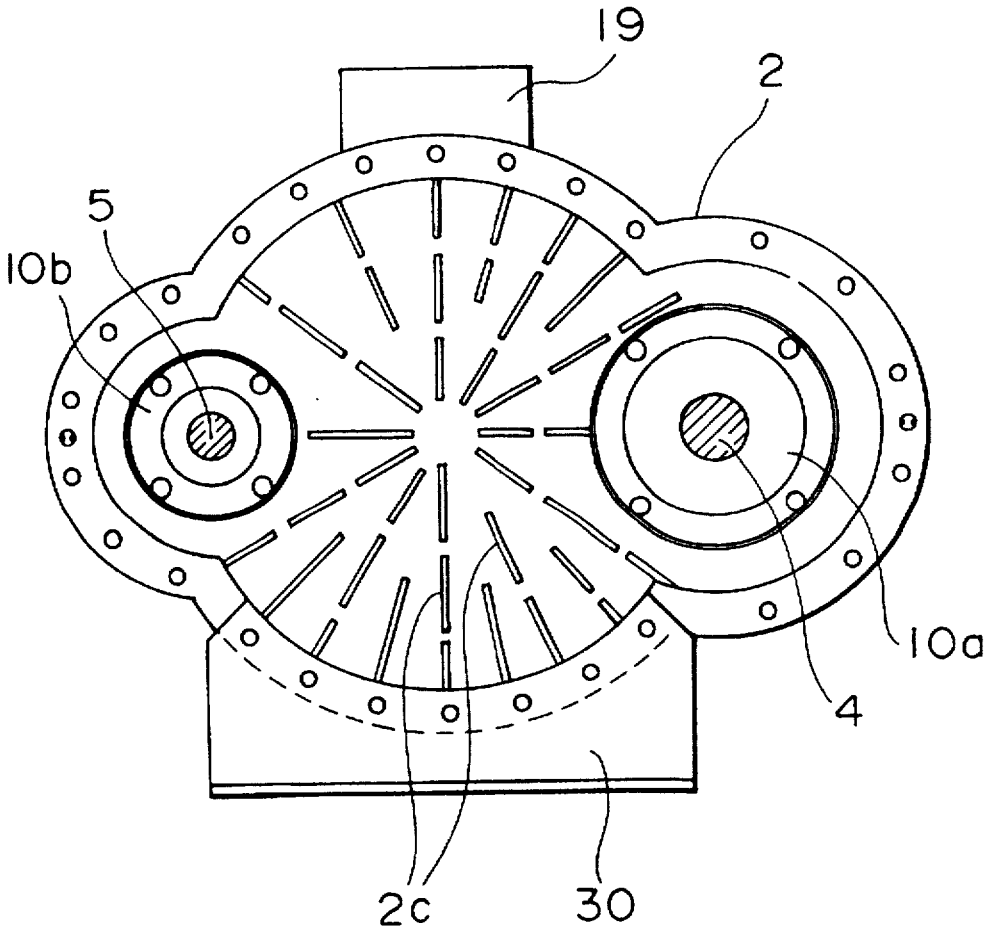
FIG. 10 is a side-elevational view showing another modified stationary scroll of the invention (for example, taken along the line M—M of FIG. 7)

In the embodiment of FIG. 10, the heat-radiating fins 2*c* are arranged radially, and cooling air is blown to a central portion of the stationary scroll 2 (from which the heat-radiating fins 2*c* radiate) in a direction perpendicular to a plane of the drawing and then flows radially along the heat-radiating fins 2*c*. In this embodiment, the cooled fins 2*c* will not limit the thermal expansion of the stationary scroll 2 in the direction passing through the two bearings 10*a* and 10*b*. Although each cooling fin 2*c* is discontinuous or interrupted in the radial direction, the fin 2*c* may be continuous in the radial direction. In this embodiment, the fins 2*c* also serve as reinforcing members reinforcing the mirror plate of the stationary scroll which withstands the pressure within the compression operating chamber. More specifically, the structure in the embodiment of FIG. 9 is relatively weak against a bending force acting in the direction of juxtaposition of the two drive shafts 4 and 5. And besides, since the cooling air is first fed to the high-temperature portion of the compressor, the effect of cooling the compressor is enhanced, and therefore the amount of thermal expansion of the whole of the compressor is decreased. As a result, the relative thermal expansion difference between the orbiting scroll 3 and the stationary scrolls is reduced, so that the load borne by each bearing can be reduced.

Figure 11:
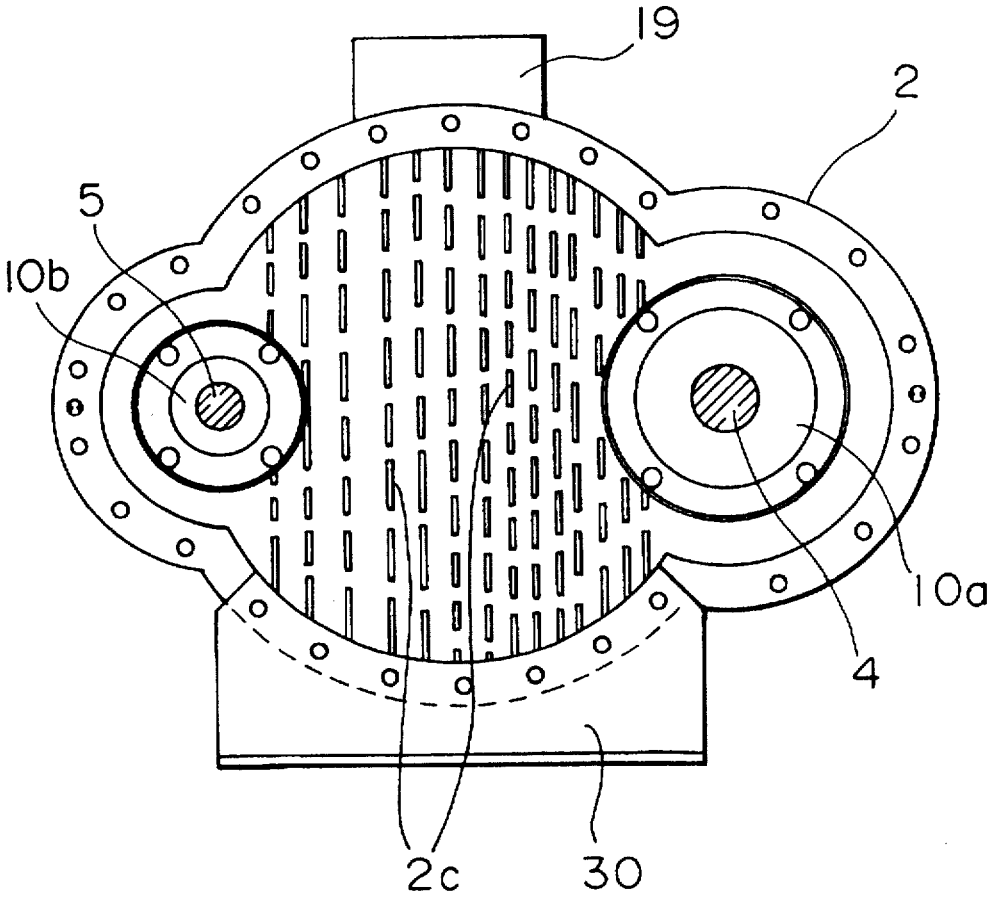
FIG. 11 is a side-elevational view showing a further modified stationary scroll of the invention (for example, taken along the line M—M of FIG. 7)

In the embodiment of FIG. 11, the fins 2*c* are arranged or oriented in the direction perpendicular to the direction passing through the two bearings 10*a* and 10*b*. With this arrangement, the fins 2*c* are cooled, and limits the thermal expansion of the stationary scroll 2 in an upward-downward direction (FIG. 11), but allows the stationary scroll 2 to thermally expand easily in the direction passing through the two bearings 10*a* and 10*c*. Cooling air flows in the upward-downward direction, along which the fins 2*c* are arranged, and effectively cools the whole of the compressor.

In the embodiments of FIGS. 9 to 11, although only one stationary scroll 2 has been described, the fins of the same configuration are basically arranged on the pair of stationary scrolls 1 and 2. However, since the discharge port 9 is formed in the central portion of one of the stationary scrolls, the arrangement of the fins on one stationary scroll may be different from the arrangement of the fins on the other stationary scroll.

Figure 12:
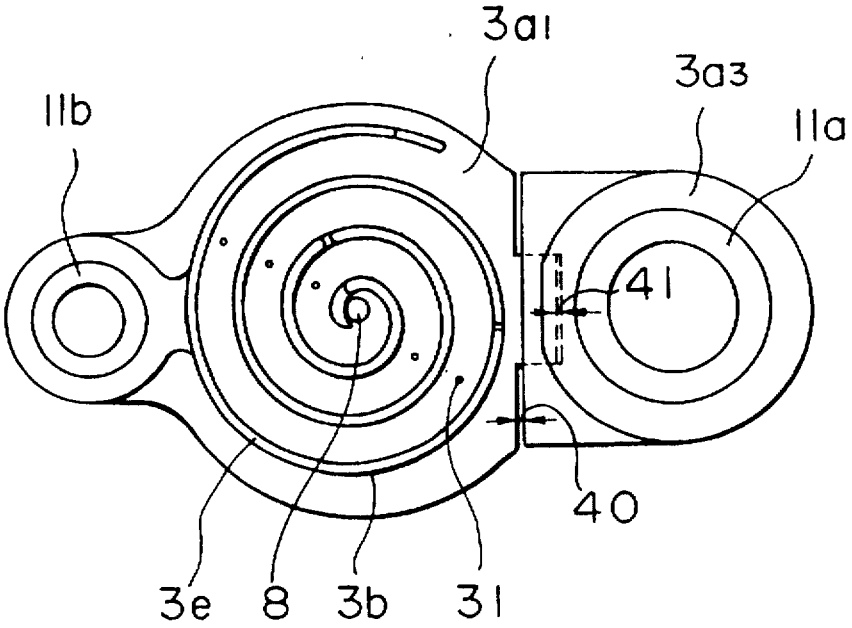
FIG. 12 is a plan view of a modified orbiting scroll of the invention.
Figure 13:
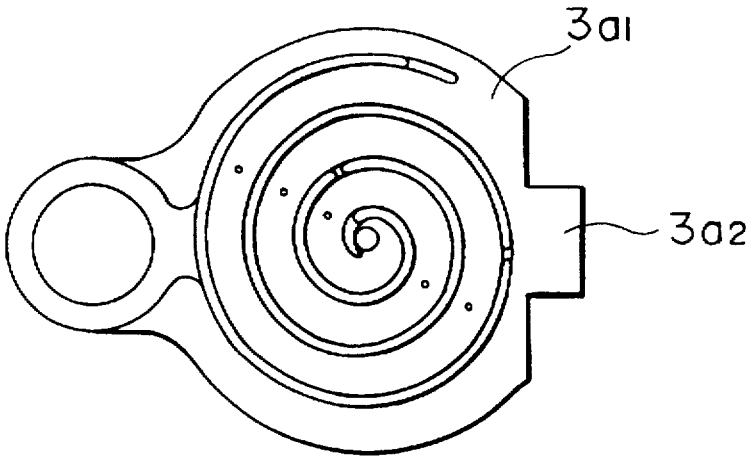
FIG. 13 is a plan view showing a part of the orbiting scroll of FIG. 12.
Figure 14:
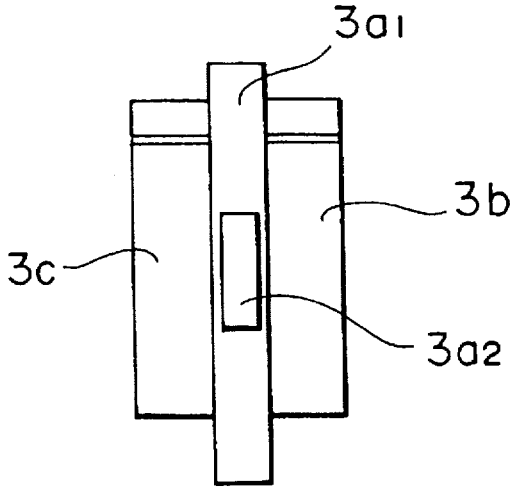
FIG. 14 is a side-elevational view of the scroll portion of FIG. 13.
Figure 15:
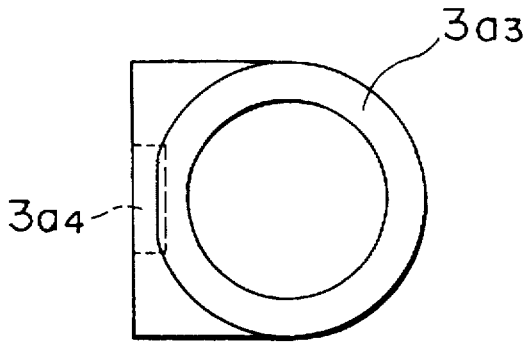
FIG. 15 is a plan view showing the other portion of the orbiting scroll of FIG. 12.
Figure 16:
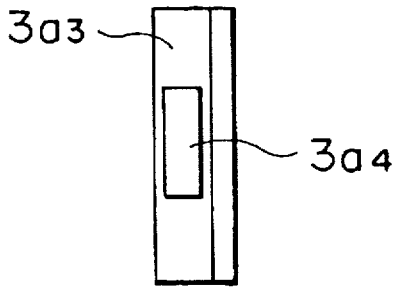
FIG. 16 is a side-elevational view of the scroll portion of FIG. 15.

Further embodiments, in which an orbiting scroll is allowed to expand in a direction of juxtaposition of two drive shafts, will now be described with reference to FIGS. 12 to 17. In these embodiments, the orbiting scroll 3 is divided into a plurality of sections, and a projecting portion and a recessed portion are formed respectively at split surfaces of the adjacent scroll sections to be mated together, and the projecting portion and the recessed portion are fitted together to be made integral, thus providing the integrally-connected orbiting scroll 3. With this construction, the fitting portions of the orbiting scroll 3 can be displaced in a direction passing through two bearings to change a distance between the axes of the bearings. As a result, the thermal expansion of the orbiting scroll 3 is accommodated for, thereby preventing an excessive load from acting on a drive shaft and an auxiliary crankshaft. FIG. 12 shows the assembled orbiting scroll 3 formed by combining the orbiting scroll portions of FIG. 13 with the orbiting scroll portion of FIG. 15. In this assembled condition of the orbiting scroll 3 in which gaps 40 and 41 are formed between the mating surfaces of the two scroll portions **3*a*1 and 3*a*3, a distance between the two bearings 11*a* and 11*b* is substantially equal to a distance between two bearings mounted on the stationary scrolls as shown in FIG. 1. Therefore, when the orbiting scroll 3 is thermally expanded during the operation of the compressor, the gaps 40 and 41 are reduced, thereby preventing an undue load from acting on the bearings. FIG. 14 is a side-elevational view of the scroll section of FIG. 13. The projecting portion 3*a*2 has a rectangular parallelepipedic shape as best shown in FIG. 13. FIG. 16 is a side-elevational view of the orbiting scroll portion of FIG. 15, and the recessed portion 3*a*4 is in the form of a recess of a rectangular parallelepipedic shape generally corresponding to the shape of the projecting portion 3*a*2, but the length of an extension of the projecting portion 3*a*2 is smaller than the depth of the recessed portion 3*a*4. Therefore, these fitting portions are prevented from movement in a direction perpendicular to the direction passing through the two bearings 10*a* and 10*b*, and can be moved only in the direction passing through the two bearings 10*a* and 10*b***.

Figure 17:
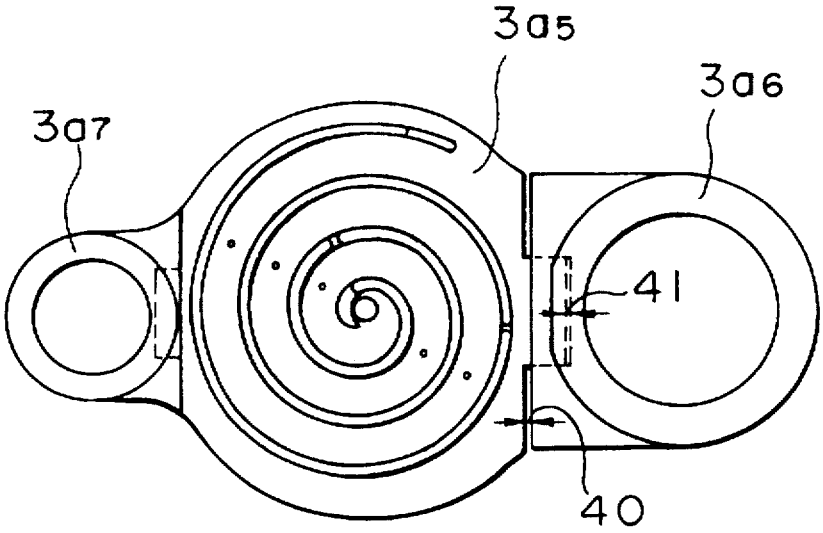
FIG. 17 is a plan view of another modified orbiting scroll of the invention.

In the embodiment of FIG. 17, the orbiting scroll 3 is divided into three portions, that is, a scroll portion **3*a*5, a drive shaft-side portion 3*a*6 and an auxiliary crankshaft-side portion 3*a*7. In this embodiment, the three divided portions can be connected together in a manner as described above for the preceding embodiment. A gap 40 may be provided at one or both of the opposite ends of the scroll portion 3*a*5**.

In the embodiments of FIGS. 12 to 17, the orbiting scroll is divided into the plurality of portions, and these divided portions can adjust only a distance between the axes of the two bearings, and therefore the thermal expansion difference between the orbiting scroll and the stationary scrolls can be suitably accommodated for while achieving the stable orbital motion of the orbiting scroll. Therefore, with this construction, even if the scroll members are thermally expanded during the operation of the compressor, an excessive load will not act on the drive shafts as in the case where the bearings are resiliently supported as described above. Therefore, the stable movement of the orbiting scroll is achieved, and the reliability of the drive shafts and the bearings are kept high, and the lifetime of the compressor is prolonged, and the time period from one maintenance to another is prolonged.

The materials for the scrolls will now be described with reference to FIG. 1. During the operation of the compressor, the temperature of the orbiting scroll 3 is higher than the temperature of the stationary scrolls 1 and 2, and therefore in order to decrease the relative thermal expansion difference, the orbiting scroll 3 can be made of a material which is lower in thermal expansion coefficient than a material for the stationary scrolls 1 and 2. Accordingly, it is possible to reduce a difference in thermal expansion between the orbiting scroll and the stationary scrolls and to lighten a load on the bearings.

Figure 18:
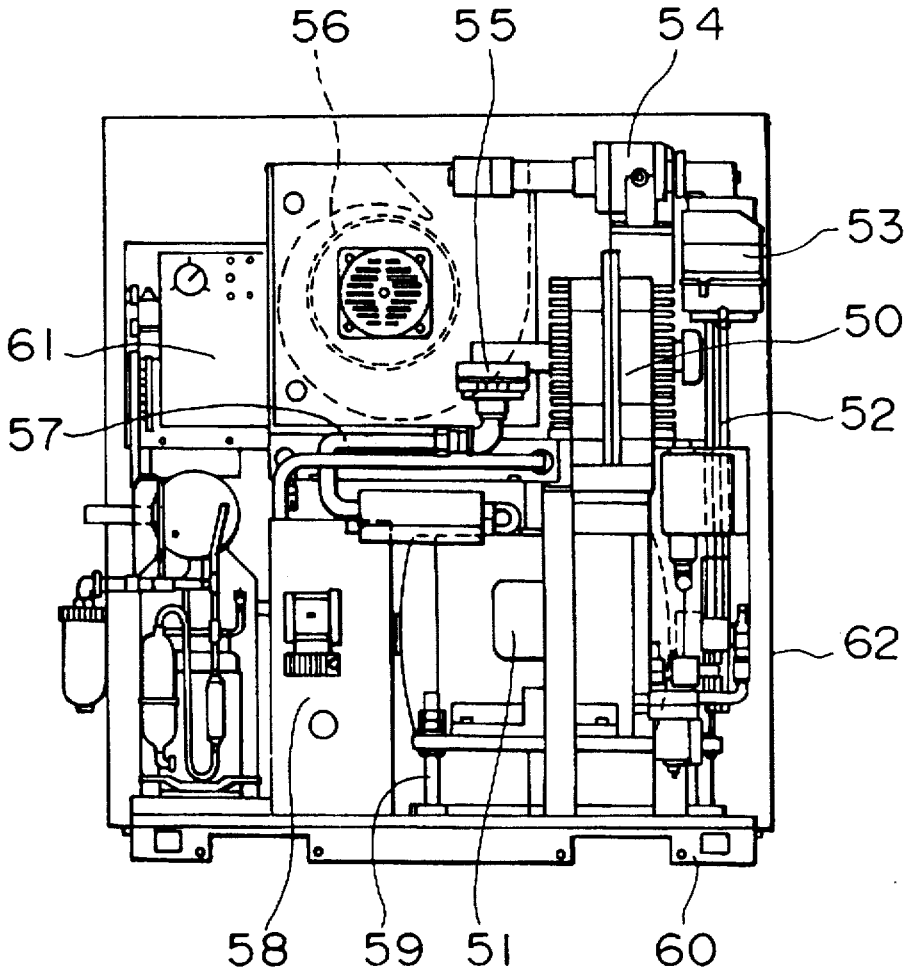
FIG. 18 is a front-elevational view of one preferred embodiment of a compressed gas-producing apparatus of the invention, with part of a box-like member removed.

One preferred embodiment of a compressed gas-producing apparatus will now be described with reference to FIG. 18. A motor 51, fixedly mounted on a motor base 59, is connected to a compressor 50 (any of the above-mentioned scroll fluid machines) by a power transmission means 52. A suction filter 53 and an unloader 54 for controlling the volume of the compressor are provided at the suction side of the compressor 50. A check valve 55 is provided at the discharge side of the compressor 50, and prevents reverse flow of high-pressure gas, for example, upon suspension of the compressor 50. A discharge pipe 57 extends from the check valve 55. Fins are formed on an outer surface of the compressor 50, and also fins are formed on an outer surface of part of the discharge pipe 57, and the compressor 50 and the discharged gas are effectively cooled by a cooling fan 56. There are provided electrical parts 58 for operating the compressor 50 and for controlling this operation. Electric power is supplied from a power source to the electrical parts 58 so as to operate the compressor 50. The above component parts are all mounted on a base 60, and are housed in a box-like member or casing 62, thus forming the compress air-producing apparatus. A dryer device 61 may be provided within the box-like member 62 so as to remove moisture from the compressed gas. The output of the compressor 50 can be easily varied by changing the sizes of pulleys mounted respectively on drive shafts of the compressor 50 and the motor 51. With this oil-free construction of the compressor, an oil tank, an oil cooler, an oil-circulating pump, and a device for controlling the pump, which have heretofore been used in the conventional construction, are unnecessary, and therefore there can be provided the apparatus which is compact in size, and can produce the oil-free gas of high pressure. The compressor 50, used in this apparatus, allows the expansion of the orbiting scroll as described in the above embodiments. Sound-insulating and vibration-insulating means may be provided on the box-like member 62, thereby providing the compressed gas-producing apparatus which is quiet even during the operation of the compressor.

In the present invention, there can be provided the scroll fluid machine in which the stable movement of the scroll is achieved, and vibration noises are reduced to a low level.

What is claimed is:

1. A scroll fluid machine, comprising:

a stationary scroll or scrolls having a scroll wrap or wraps of a volute configuration, an orbiting scroll having a scroll wrap or wraps engaged with said scroll wrap or wraps of said stationary scroll or scrolls, a pair of drive shafts fitted at respective fitted portions of said stationary scroll or scrolls for rotation in said stationary scroll or scrolls and fitted at respective fitted portions of said orbiting scroll for imparting an eccentric motion to said orbiting scroll, said pair of drive shafts having means for being rotatable in synchronism with each other, an expansion allowing member provided at at least one of said fitted portions for allowing expansion of said orbiting scroll in a direction along a line connecting said drive shafts to each other and not in a direction perpendicular to said line connecting said drive shafts to each other.

2. A machine according to claim 1, in which said drive shafts are rotatably supported by said stationary scroll through bearings, and said expansion-allowing member is provided on said bearings so that said drive shafts, supported by said bearings, can be resiliently supported in a direction of juxtaposition of said drive shafts.

3. A machine according to claim 1, in which said expansion-allowing means comprises at least one resilient member provided on at least one of said crank means on said drive shafts.

4. A machine according to claim 3, in which a crank of said at least one drive-shaft is rotatably supported in one of said fitted portions of said orbiting scroll by a bearing, and said at least one resilient member is provided on said bearing.

5. A machine according to claim 4, in which said at least one resilient member is made of a polymeric material, and is resilient in a direction of juxtaposition of said drive shafts, and is non-resilient at least in a direction substantially perpendicular to said direction of juxtaposition.

6. A machine according to claim 4, in which said at least one resilient member comprises a metal spring which is resilient in the direction of juxtaposition of said drive shafts.

7. A machine according to claim 1, in which cooling fins are formed on outer surfaces of said stationary scroll or scrolls to allow said stationary scroll to expand in a direction of juxtaposition of said drive shafts.

8. A machine according to claim 7, in which each of said cooling fins is discontinuous in the direction of juxtaposition of said drive shafts.

9. A machine according to claim 7, in which said cooling fins are oriented in a direction substantially perpendicular to the direction of juxtaposition of said drive shafts.

10. A machine according to claim 7, in which said cooling fins extend radially from a central portion of said stationary scroll or scrolls.

11. A scroll fluid machine comprising:

a stationary scroll or scrolls having a scroll wrap or wraps of a volute configuration;

a plurality of drive shafts mounted on said stationary scroll or scrolls having means for rotation in synchronism with each other, and having crank means;

an orbiting scroll revolved by said crank means of said drive shafts, and having a scroll wrap or wraps engaged with said scroll wrap or wraps of said stationary scroll or scrolls;

means for allowing expansion of said orbiting scroll in a direction along a line connecting said drive shafts to each other and not in a direction perpendicular to said line connecting said drive shaft to each other; and cooling fins formed on an outer surface of said stationary scroll or scrolls, and, allowing said stationary scroll or scrolls to expand in a direction of juxtaposition of said drive shafts.

12. A machine according to claim 11, in which said orbiting scroll is divided into a plurality of scroll portions in the direction of juxtaposition of said drive shafts, and are connected together in such a manner that said scroll wrap of said orbiting scroll is movable in said direction, but is immovable in a direction substantially perpendicular to said direction.

* * * * *